United States Patent [19]

Gross

[11] 4,198,892

[45] Apr. 22, 1980

[54] TONE GENERATOR FOR ELECTRONIC MUSICAL INSTRUMENT WITH DIGITAL GLISSANDO, PORTAMENTO AND VIBRATO

[75] Inventor: Glenn M. Gross, Chicago, Ill.

[73] Assignee: Norlin Industries, Inc., Lincolnwood, Ill.

[21] Appl. No.: 961,222

[22] Filed: Nov. 16, 1978

[51] Int. Cl.[2] ..... G10H 1/02; G10H 5/00

[52] U.S. Cl. ..... 84/1.25; 84/1.24

[58] Field of Search ..... 84/1.01, 1.03, 1.24, 84/1.25, DIG. 11

[56] References Cited

U.S. PATENT DOCUMENTS

| | | | |
|---|---|---|---|
| 3,929,053 | 12/1975 | Deutsch | 84/1.24 |
| 4,070,942 | 1/1978 | Aoki | 84/1.01 |
| 4,073,209 | 2/1978 | Whittington et al. | 84/1.24 |
| 4,103,581 | 8/1978 | Deutsch | 84/1.24 |
| 4,152,966 | 5/1979 | Deutsch | 84/1.24 |

OTHER PUBLICATIONS

RCA Solid State Division, DIGITAL INTEGRATED CIRCUITS, Application Note ICAN-6739, Sep. 1974.

RCA COS/MOS INTEGRATED CIRCUITS DATA BOOK, Copyright 1977, pp. 227-230.

ELECTRONOTES, vol. 6, No. 42, Aug. 5, 1974, pp. 1-11.

*Primary Examiner*—S. J. Witkowski

*Attorney, Agent, or Firm*—Ronald J. Kransdorf; Jack Kail

[57] ABSTRACT

A tone generator for use with an electronic musical instrument includes a binary counter operated by a binary comparator and a source of clock signals for incrementally advancing or decreasing the state of the counter from a first selected state to a second selected state. The states of the counter control a programmable divider which develops corresponding output tone signals. The counter produces multiple state changes between the selected states so that each individual state change results in a frequency change which is inaudible. The overall effect is to thereby synthesize a tone signal creating the illusion of a continuous pitch change between the pitches corresponding to the selected counter states. The source of clock signals includes a rate multiplier programmed according to the states of the counter to compensate system operation for insuring that similar musical effects defined by corresponding musical intervals are produced in equal time intervals. In a vibrato mode, a second rate multiplier is provided to insure that, for a given frequency output tone signal, different vibrato depths result in vibrato cycles of equal time intervals.

34 Claims, 12 Drawing Figures

FIG. 1
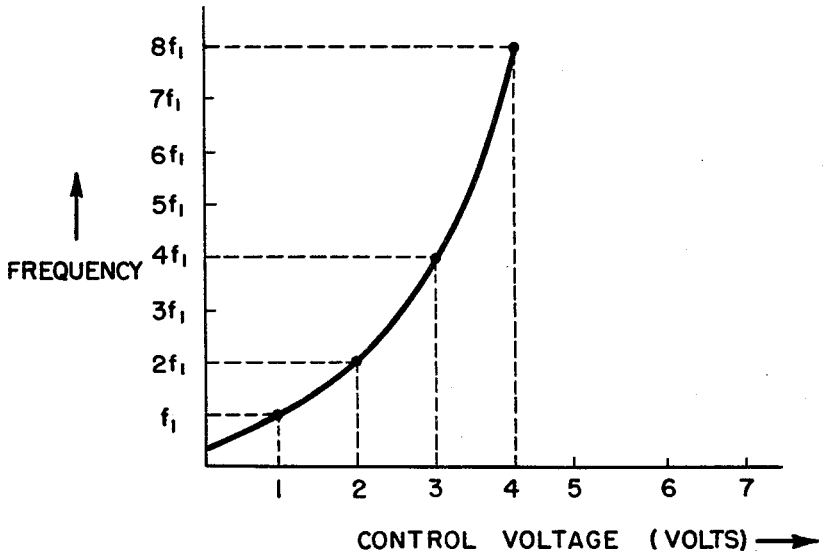
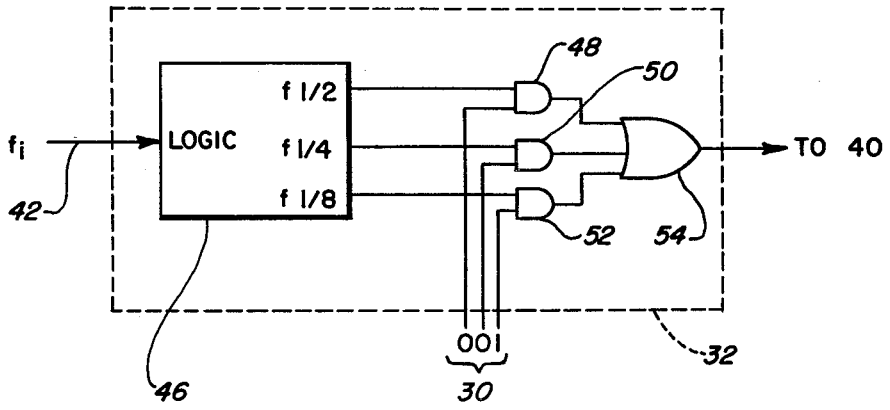
FIG. 3

| NOTE | PITCH CONTROL CODE | ADDRESS |
|---|---|---|
| C1 | 61153 | 1 |
| C#1 | 57720 | 2 |
| D1 | 54481 | 3 |
| ⋮ | ⋮ | ⋮ |
| C6 | 1911 | 61 |

16 BITS | 6 BITS

TONE GENERATOR FOR ELECTRONIC MUSICAL INSTRUMENT WITH DIGITAL GLISSANDO, PORTAMENTO AND VIBRATO

BACKGROUND OF THE INVENTION

The present invention relates to tone generators for use in electronic musical instruments and, more particularly, to a digital tone generator useful for simulating musical effects such as portamento, glissando and vibrato.

Portamento, glissando and vibrato are effects commonly used in accoustical and electronic musical instruments, all three effects involving the feature of changing the pitch of a note being sounded. The portamento effect, for example, comprehends the production of a continuous change of pitch over a musical interval extending between two selected notes. The effect of glissando is similar in nature but the change in pitch normally extends for a fixed musical interval from a selected note. Vibrato, on the other hand, results from cyclically increasing and decreasing the pitch of a selected note by a given deviation about the selected note.

Due to the interval nature of the musical scale, and the auditory perception thereof, the foregoing musical effects are characterized in that corresponding musical intervals are ideally swept in equal time intervals. Consider, for example, producing a portamento effect between two notes $f_1$ and $2f_1$ defining the lower and upper boundaries of a particular octave. At a given sweep rate, it will take a time interval $\Delta t$ to sweep the frequency band between the two notes. Now, consider producing a portamento effect between two notes $2f_1$ and $4f_1$ defining the lower and upper boundaries of the next higher octave. It will be appreciated that if this octave were linearly swept at the same rate as the lower octave, the resulting time interval will be greater than $\Delta t$ due to the fact that the higher octave defines an increased range of frequencies as compared to the lower octave. The same phenomenon occurs when considering glissando and vibrato effects. That is, unless suitable precautions are taken, the production of these musical effects over corresponding musical intervals in different portions of the musical scale will not be performed in equal time intervals.

Conventionally, electronic musical instrument tone generators have been analog in nature wherein the musical tone signals are generated by applying suitable control voltages to a voltage controlled oscillator (VCO). The VCO is commonly characterized by an exponential response and operated in response to a linear control voltage. Alternatively, the linear control voltage may be coupled through an exponential conversion circuit to a VCO having a linear response. In either case, the effect is the same; namely, a true reproduction of the musical scale in response to a linear control voltage. That is, identical incremental control voltage changes in different portions of the musical scale will cause the VCO to produce different tone signal frequency deviations defining corresponding musical intervals. To illustrate the foregoing, FIG. 1 shows an exemplary transfer function of an exponential VCO. It will be observed that sweeping the control voltage from 1 volt to 2 volts produces a frequency sweep from $f_1$ to $2f_1$ defining a particular octave. Similarly, sweeping the control voltage from 3 volts to 4 volts, i.e. the same incremental control voltage change as before, produces a frequency sweep from $4f_1$ to $8f_1$ which defines a higher octave. Although, in terms of frequency, the band swept is four times larger it nevertheless occupies a single octave as did the control voltage sweep from 1 to 2 volts. Of course, the same principal applies to control voltage increments defining musical intervals less or more than one octave.

The prior art exponential tone generator graphically represented in FIG. 1 inherently produces proper portamento and glissando effects when the control voltage is suitably modulated. For example, sweeping the control voltage at a constant rate between 1–2 volts and 3–4 volts produces continuous frequency changes in equal time intervals for corresponding musical intervals, in this case octaves.

The prior art VCO type vibrato tone generator has typically been operated in the exponential mode although, recently, linear mode operation has also been utilized to achieve more symmetrical results. Assume a vibrato effect is desired having a center frequency of $1.0f_1$ and a depth of 1.1. The control voltage would be suitably modulated for causing the output frequency to cyclically sweep at a constant rate between $0.9f_1$ and $1.1f_1$. Thus, the total frequency deviation of $0.2f_1$ would be swept in some given time interval. Now, assume that a vibrato effect is desired about a center frequency two octaves about $1.0f_1$, i.e. $4f_1$, but having the same vibrato depth. The control voltage would now be modulated for causing the output frequency to cyclically sweep at a constant rate between $3.6f_1$ and $4.4f_1$ resulting in a total frequency deviation of $0.8f_1$. However, even though the latter frequency deviation is, in terms of frequency, four times that produced in the former octave, the musical intervals are corresponding and are therefore swept in equal time intervals since equivalent control voltage increments produce the two different deviations.

Digital tone generatores are, to a large extent, presently replacing the prior art analog systems. Such digital generators frequently utilize suitably controlled programmable frequency dividers to produce the requisite tone signals. To this end, a high frequency clock signal is typically applied to the clock input of the divider which is set by an appropriate program code for dividing the clock signal by a particular divisor to achieve a tone signal having a desired frequency. Portamento, glissando or vibrato may then be achieved by suitably varying or modulating the program code supplied to the divider such that the desired frequency change is exhibited by the output tone signal. Thus, a digital system of this type for producing the musical effects or portamento, glissando and vibrato must necessarily comprehend means for producing a program code for appropriately controlling the divider.

One possible technique for producing the requisite program code involves means for sequentially increasing or decreasing the program code supplied to the divider by means of a counter or the like. The increasing or decreasing program code would cause the divisor of the divider to sequentially change in a like manner and at a constant rate whereby a tone signal is produced whose frequency also changes at a constant rate. However, the time intervals during which frequency changes occur over corresponding musical intervals would not be constant but rather would depend upon the location within the musical scale at which the change is being effected. Consider, for example, the production of portamento effects between the notes corresponding to $f_1$ and $2f_1$ and the notes corresponding to $4f_1$ and $8f_1$. In this example, the program code supplied to the divider must be sequenced through one fourth times as many state changes or steps to sweep the latter octave, which in terms of frequency corresponds to a band of $4f_1$, as compared to the former which only occupies a frequency range of $f_1$. As a consequence, the octave between $4f_1$ and $8f_1$ will be swept in a time interval four times less than that required to sweep the octave between $f_1$ and $2f_1$. As mentioned previously, from a musical viewpoint, the effects of portamento, glissando and vibrato are not properly produced when corresponding musical intervals are swept in unequal time intervals. Accordingly, a digital scheme implemented by a counter which is sequentially stepped at a constant rate for controlling a programmable divider would not properly simulate the musical effects of portamento, glissando and vibrato.

In addition, known digital tone generators lack the capability for providing certian frequently desired features characterizing the production of vibrato effects. In particular, they lack the ability to maintain the vibrato depth constant for different selected center frequencies as well as the ability to perform complete vibrato cycles about a selected center frequency in equal time intervals regardless of the vibrato depth.

SUMMARY OF THE INVENTION

It is accordingly an object of the invention to provide a digital tone generator for an electronic musical instrument capable of properly simulating the effects of portamento, glissando and vibrato over the range of an entire musical scale.

The foregoing is achieved by means of a programmable divider operated in response to a high frequency clock signal and an input program control code for producing variable frequency output tone signals. The program control code is developed at the output of an up/down counter which is supplied from a constant frequency rate control clock through a rate multiplier, the program inputs of the rate multiplier also being coupled for receiving the program control code from the counter. A comparator includes a first input coupled for receiving a pitch control code, a second input connected to the output of the counter and means enabling the counter for counting in a direction so as to equalize the value of the binary words present at its two inputs.

In operation, portamento or gllissando may be achieved by initially presetting the counter with a pitch control code corresponding to a first musical note, the preset pitch control code being simultaneously applied from the counter output to the programmable divider, the second input of the comparator and the program inputs of the rate multiplier. Next, a pitch control code corresponding to a second musical note is supplied to the first input of the comparator which causes the counter to sequentially count from the first pitch control code toward the second code. The divider responds to the sequentially changing count by producing tone signals continuously changing in frequency from the first note toward the second note. Upon achieving equality at its two inputs, the comparator disables the counter so that the divider is producing an output tone signal having a frequency corresponding to the second note. As mentioned, the program control code developed by the counter is also used to program the rate multiplier. Thus, the multiplicand characterizing the rate multiplier is directly proportional to the binary value of the program control code. Consequently, the frequency of the signal clocking the counter is also directly proportional to the binary value of the program control code. In portions of the musical scale corresponding to high binary value program control codes, where a high number of counter state changes are required to sweep a given musical interval, the counter is therfore clocked at a correspondingly fast rate. In regions of the musical scale corresponding to lower binary value control codes, where fewer counter state changes produce a corresponding musical interval, the counter is clocked at a proportionately slower rate. The variable rate signal clocking the counter therefore proportionately compensates for the difference in counter state changes required to sweep corresponding musical intervals anywhere in the musical scale thereby insuring that they will be swept in equal time intervals.

Vibrato effects are achieved in a substantially similar manner except that the first input to the comparator is driven by a code representing a signal cyclically varying about a center frequency. The code is produced by combining a pitch control code with a vibrato depth code in a manner such that a constant vibrato depth is achieved for different frequency tone signals. Also, a second rate multiplier, coupled between the first rate multiplier and the rate control clock and responsive to the vibrato depth code, may be used to compensate the rate of change of the counter for varying vibrato depths. This would insure that a complete vibrato cycle about a selected center frequency would be accomplished in a given time interval regardless of the vibrato depth.

BRIEF DESCRIPTION OF THE DRAWINGS

FIG. 1 is a graph illustrating the operation of a prior art tone generator.

FIG. 3 shows a rate multiplier exemplary of the type used in the circuit of FIG. 2.

DETAILED DESCRIPTION OF THE PREFERRED EMBODIMENT

Figure 2:
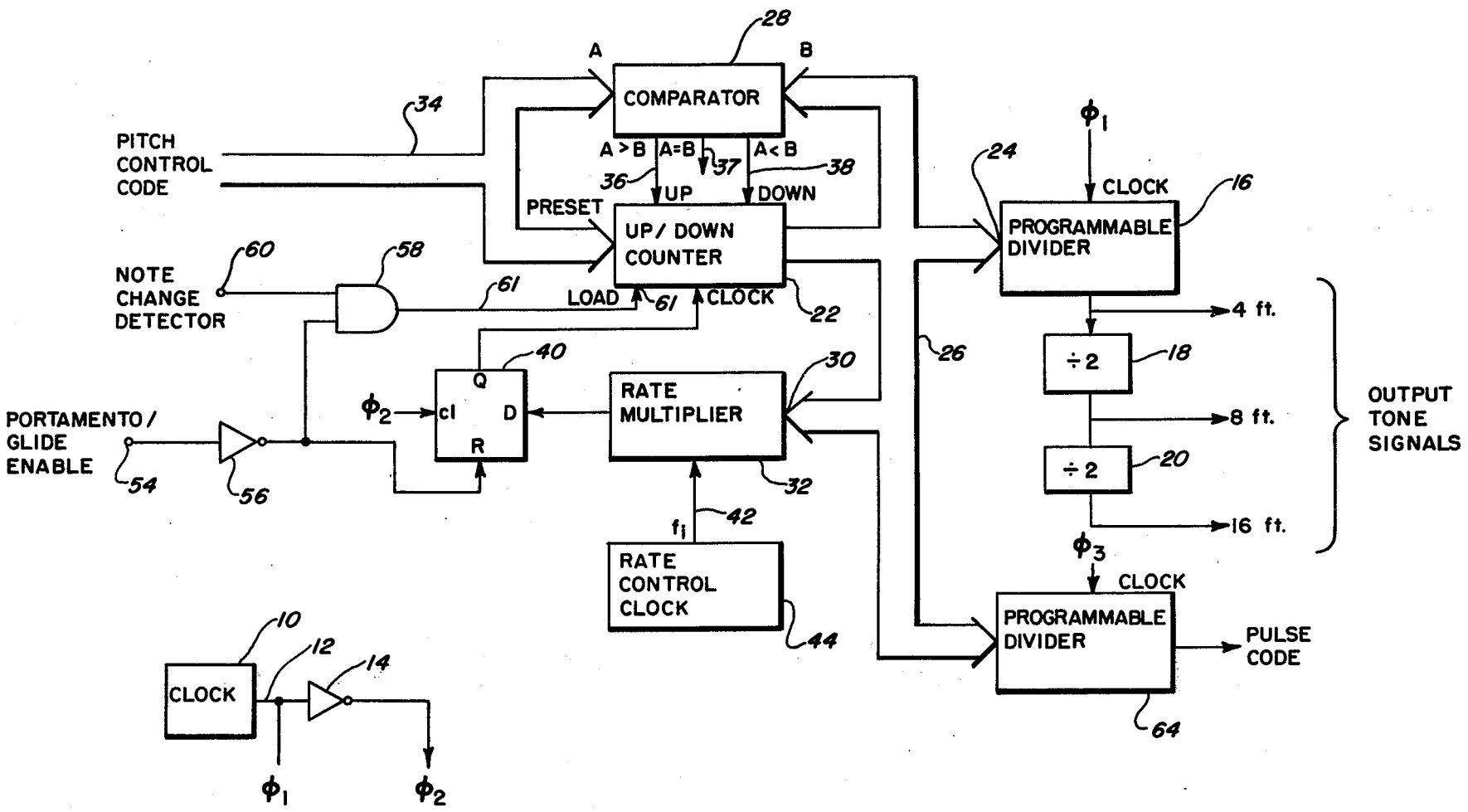
FIG. 2 is a functional block diagram illustrating the circuit of the present invention arranged for producing the musical effects of glissando and portamento.

Referring now to the drawings, FIG. 2 shows a circuit embodiment for digitally producing the musical effects of portamento and glissando according to the invention. The circuit is referenced to a stable high frequency clock 10 which may comprise a crystal oscillator, the clock 10 providing a first phase clock signal $\phi_1$ at its output 12 and a second phase clock signal $\phi_2$ at the output of an inverter 14 having its input coupled to output 12. Clock signal $\phi_1$ is applied to the clock input of a programmable divider 16 which acts as a frequency synthesizer to generate a 4 foot output tone signal which is, in turn, further subdivided by dividers 18 and 20 to produce 8 foot and 16 foot output tone signals.

The division ratio characterizing divider 16, and therefore the frequency of the output tone signals, is determined by a program control code developed at the output of a 16 stage up/down counter 22 and supplied to the program inputs 24 of divider 16 via a data bus 26. It will be appreciated that data bus 26 actually consists of 16 individual lines, one each of the lines being connected from a stage of counter 22 to a respective program input of divider 16. Data bus 26, in addition, connects the output of counter 22 to an input B of a binary comparator 28 and to the program inputs 30 of a binary rate multiplier 32.

A 16 bit pitch control code, corresponding to a selected musical note, is coupled over a second bus 34 to a second input A of comparator 28 and to the preset inputs of counter 22. Comparator 28, in response to the value of the binary words presented at its two inputs A and B, commands counter 22, by developing appropriate logic signals on a pair of control lines 36 and 38, for equalizing the value of the two binary words. Thus, when the value of the 16 bit binary word present at input A exceeds the value of of the 16 bit binary word present at input B, a logic signal is developed on line 36 causing counter 22 to incrementally advance its state in response to a clock signal supplied from the Q output of a flip-flop 40. Counter 22 will continue to so advance until the value of the binary word supplied to the B input of comparator 28 equals the value of the binary word supplied to the comparator's A input. Upon achieving equalization A=B control line 37 goes logically high and comparator 28 inhibits counter 22 by removing the logic signal previously developed on line 36. In a similar manner, whenever the value of the binary word presented to comparator input A is less than the value of the biary word presented to input B, a logic signal is developed on control line 38 causing counter 22 to incrementally decrease its state in response to clock pulses developed at the Q output of flip-flop 40. Again, upon equalization of the value of the binary words presented at comparator inputs A and B, the logic signal is removed from line 38 inhibiting counter 22 from further changing state.

Now, it will be recalled that the program control code setting the divide ratio of programmable divider 16 is developed at the output of counter 22. Thus, as the counter changes state in either direction in response to command signals on control line 36 or 38, the divide ratio of divider 16 is similarly changed. As a consequence, as the state of counter 22 is incrementally advanced in response to a signal on control line 36, the divide ratio of divider 16 is similarly increased whereby the frequency of the output tone signal continuously decreases at a corresponding rate. Likewise, as the state of counter 22 decreases in response to a signal on control line 38, the divide ratio of divider 16 also decreases at the same rate whereby the frequency characterizing the output tone signal correspondingly increases. As mentioned previously, the clocking signal driving counter 22 is derived from the Q output of flip-flop 40. Flip-flop 40 has its clock input connected for receiving clock signal $\phi_2$ and its D input connected to the output of rate multiplier 32. Lastly, a clock signal is applied to rate multiplier 32 over a line 42 from a rate control clock 44. As will be described in further detail hereinafter, the primary purpose of rate multiplier 32 is to compensate the program control code generating system for insuring that corresponding musical intervals are swept in equal time intervals regardless of the location within the musical scale in which the system is operating.

More specifically, assume that counter 22 is being operated for generating a program control code such that the frequency of the output tone signal is being decreased in a relatively high octave of the musical scale. This implies that both the division ratio characterizing divider 16 and the value of the program control code developed at the output of counter 22 are relatively low in value necessitating a relatively small number of counter state changes to sweep a given musical interval. Now, consider sweeping a corresponding musical interval but in a lower octave of the musical scale. In this case, the divide ratio characterizing divider 16 and the program control code developed by counter 22 are larger in value than in the previous case necessitating a greater number of counter state changes to sweep the same interval. Consequently, without the compensation effect introduced by rate multiplier 32, the sweep in the lower octave would require a proportionately larger time interval to accomplish. Basically, rate multiplier 32 obviates the foregoing problem by causing counter 22 to clock at an increased rate for larger program control codes and at a proportionately slower rate for smaller value program control codes.

The operation of rate multiplier 32 may be more fully understood with reference to the simplified schematic diagram of FIG. 3. According to the figure, a 3 bit rate multiplier includes a logic section 46, a triad of AND gates 48, 50 an 52 and an output OR gate 54. Logic section 46 processes the input clock signal $f_i$ supplied on line 42 by providing three divided outputs; $f_i/2$, $f_i/4$ and $f_i/8$. Each of the divided outputs is coupled from logic section 46 to a first input of a respective one of AND gates 48, 50 and 52. The outputs of AND gates 48, 50 and 52 are in turn coupled to the input of OR gate 54 whose output comprises the output of the rate multiplier. Finally, the second inputs of AND gates 48, 50 and 52 together constitute the program inputs of the rate multiplier.

By suitably energizing or programming the program inputs of the rate multiplier it will be observed that the frequency characterizing the signal developed at the output of OR gate 54 can be made to equal any of the values $f_i/8$, $f_i/4$, $3f_i/8$, $f_i/2$, $5f_i/8$, $3f_i/4$, and $7f_i/8$. Thus, the illustrated program input code 001 would result in the production of an output signal having a frequency $f_i/8$. In this case, only the divided output $f_i/8$ would be coupled through the triad of AND gates and therefrom to the output of OR gate 54. On the other hand, the program input code 111 would result in all of the divided outputs being coupled through the AND gate triad and summed in OR gate 54 to produce the output $7f_i/8$. Other program input codes would result in the enablement of other combinations of the AND gates whereby all of the previously enumerated fractional divided outputs could be developed. It will thus be observed that the effect of the rate multiplier is to multiply the frequency of the input signal by a fraction n/8 where n is an integer less than 8 determined by the program input code.

The rate multiplier used in the embodiment of the invention illustrated in FIG. 2 is a 16 bit device, such four RCA Model Nos. CD4089 connected additively, rather than a 3 bit device but otherwise operates in a functionally similar manner. Rate multiplier 32 therefore effectively multiplies the clock signal developed on line 42 by the fraction n/65,536 where n is an integer less than 65,536 as determined by the 16 bit binary word supplied to program input 30 from counter 22. Thus, rate multiplier 32 is operable for multiplying the clock signal developed on line 42 by the fractions 0, 1/65,536, 2/65,536, . . . 65,535/65/536 in response to input program codes having values ranging from 0 to 65,536 (corresponding to a 16 bit code composed of all 1's).

Figure 4:
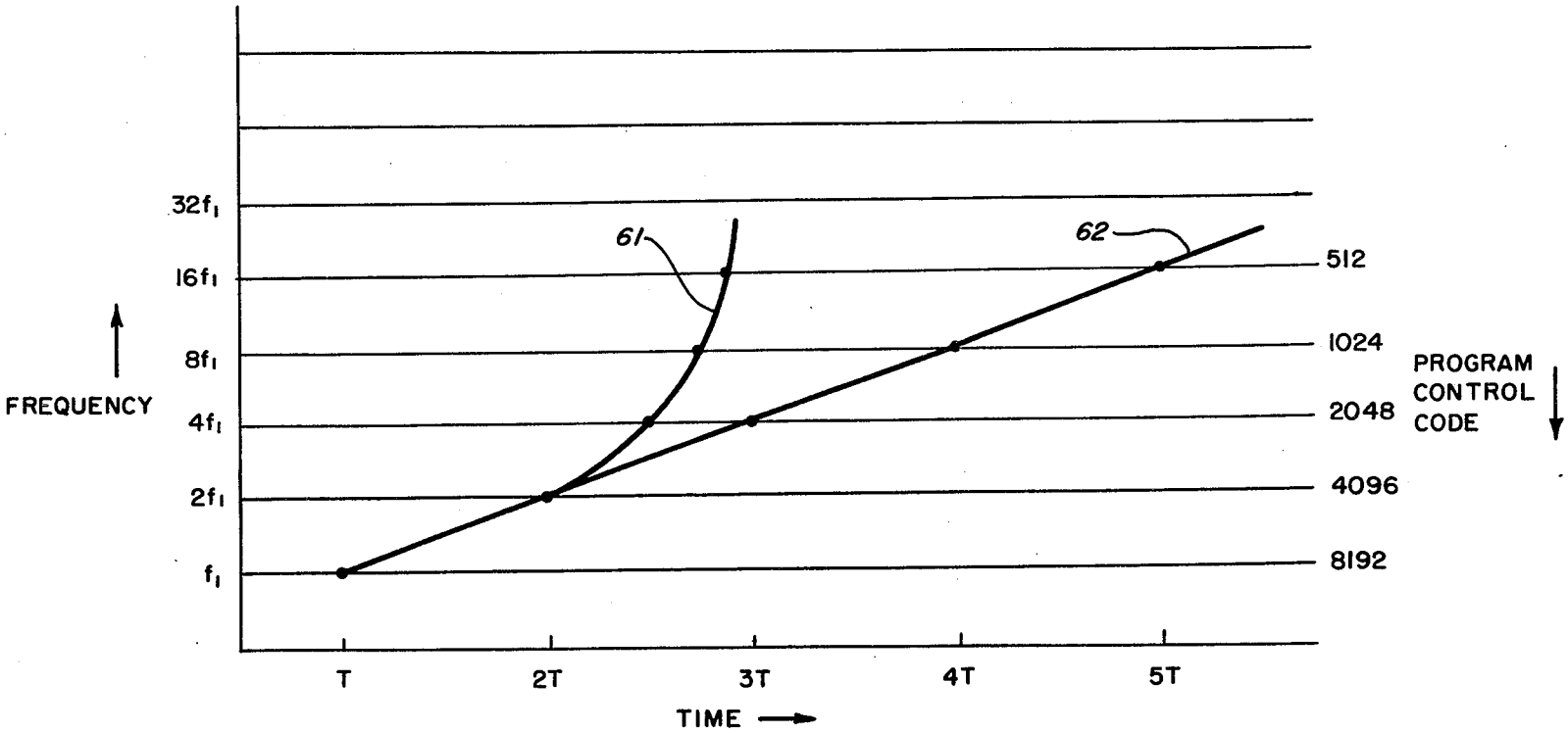
FIG. 4 is a graph depicting the operation of the circuit of FIG. 2.

Operation of the circuit of FIG. 2 will now be more readily understood with reference to the graph shown in FIG. 4. Assume that it is initially desired to produce a tone signal at the 4 foot output of programmable divider 16 having a frequency $f_1$. In this normal mode of operation, i.e. not involving portamento or glissando effects, the portamento/glissando enable input 54 is held logically low whereby a logically high level signal is coupled by an inverter 56 to the reset input of flip-flop 40 and to a first input of an AND gate 58. Flip-flop 40 is thereby held in reset preventing the application of clocking pulses to counter 22 and AND gate 58 is enabled for coupling signals from a note change detector input 60 to the load input 61 of counter 22. Note change detector input 60, which may be derived from a conventional priority note generator or the like, goes logically high whenever the generator is assigned a new note as represented by the pitch control code supplied to bus 34. See, for example, copending U.S. patent application Ser. No. 835,832 filed Sept. 27, 1977 in the name of Swain et al and assigned to the assignee of the present application entitled "Tone Generating System for Electronic Musical Instrument".

Continuing with the foregoing example, operation of the musical instrument key representing a note corresponding in pitch to a tone output signal of frequency $f_1$ results in the development of a logically high level signal at input 60 which is coupled through AND gate 58 to the load input of counter 22. At the same time, a pitch control code, having a value corresponding to a tone output signal of frequency $f_1$, is coupled to the A input of comparator 28 and to the preset inputs of counter 22. Due to the high level signal at the load input 61 of counter 22, the selected pitch control code is loaded into the counter and becomes the initial value of the program control code developed at the output of the counter.

Now, since counter 22 is not being clocked (flip-flop 40 is being held in reset by the logically high output of inverter 56), it functions as a latch continuously developing at its output a program control code identical to the initial pitch control code and corresponding to the selected note. This code sets programmable divider 16 for suitably dividing the $\phi_1$ clock pulses for producing a tone output signal characterized by a frequency $f_1$. For purposes of illustration, it is assumed in FIG. 4 that a program control code of 8192 results in the generation of an output tone signal of frequency $f_1$.

It will be observed that the program control code is also applied to the B input of comparator 28 and to the program input 30 of rate multiplier 32. However, since the A and B inputs of comparator 28 are equal, neither control line 36 nor 38 is energized. Moreover, although rate multiplier 32 is generating an an output (the frequency of which is equal to 8192 $f_i$/65,536) it has no effect on system operation since flip-flop 40 is being held in reset. Consequently, the circuit produces, at the 4 foot output of divider 16, a continuous tone output signal having a frequency $f_1$.

If it is now desired to, for example, sweep the instrument from the note being played (corresponding to tone output signal $f_1$) to a new note, portamento/glissando input 54 is forced to a logically high level through the use of a manually operated switch or the like and the new note is selected by operation of the corresponding instrument key. The high level signal developed at input 54 is converted to a low level logic signal at the output of inverter 56 which inhibits AND gate 58 and takes flip-flop 40 out of reset. The new pitch control code is coupled by bus 34 to the preset inputs of counter 22 and the A input of comparator 28. Referring to FIG. 4, assume the new pitch control code corresponds to a note represented by a tone output signal having a frequency $2f_1$ which is produced in response to a program control code corresponding to 4096. It will be observed that the new pitch control code, i.e. 4096, has no direct effect on counter 22 due to the absence of a load signal insured by the inhibition of AND gate 58. Comparator 28, however, now sees a difference between the values of the 16 bit binary words presented to its A and B inputs. In particular, the A input is presented with a binary word corresponding to 4096 while the B input is presented with a binary word corresponding to 8192. Comparator 28 will therefore develop a logic signal on control line 38 enabling counter 22 for incrementally decreasing its state from 8192 towards 4096 in response to clock pulses developed at the Q output of flip-flop 40. Therefore, counter 22 will incrementally decrease the program control code cuausing the output tone signal to continuously increase in frequency toward $2f_1$. Upon the attainment of equalization between the A and B inputs of comparator 28, i.e. both inputs corresponding to 4096, the logic signal is removed from control line 38 disenabling counter 22 from further decreasing in state. At this time, the output tone signal will have been swept in frequency from $f_1$ to $2f_1$ in a time period T corresponding to 4096 state changes of counter 22. Moreover, each of the individual state changes comprising the total sweep from 8192 to 4096 results in an inaudible frequency change. Therefore, the overall effect of the frequency sweep is to create the illusion of a continuous pitch change between the selected pitches or frequencies $f_1$ and $2f_1$.

To summarize the foregoing, the musical instrument illustrated in FIG. 2 was initially operated for generating a tone signal having a frequency $f_1$ corresponding to a program control code of 8192. Subsequently, the frequency of the tone signal was swept one octave from $f_1$ to $2f_1$ in a time interval T. At the end of this time interval the instrument was continuously producing a tone signal having a frequency 2f corresponding to a program control code of 4096.

Next, assume that it is desired to sweep the instrument another octave or, in other words, to sweep the frequency of the output tone signal from $2f_1$ to $4f_1$. the procedure to accomplish such is essentially as described before except that the appropriately different instrument key is operated. The new pitch control code supplied to input A of comparator 28 from bus 34 is now 2048 while the value of the code supplied to the B input of comparator 28 is the program control code 4096 corresponding to a tone signal of frequency $2f_1$. As before, counter 22 will incrementally decrease its state and thereby the program control code from 4096 to 2048 at which time the two comparator inputs will be equalized. The incrementally decreasing program control code will have caused programmable divider 16 to sweep the output tone signal from frequency $2f_1$ (corresponding to program control code 4096) to $4f_1$ (corresponding to program control code 2048). It will be observed that in sweeping this latter octave counter 16 has undergone 2048 state changes while, in sweeping the former octave (from the $f_1$ to $2f_1$), the counter experienced two times this number of state changes, i.e., 4096 state changes. Therefore, without compensating for this difference, as would be the case if counter 22 were operated in response to a constant frequency clock signal, it would require one-half the time to sweep the octave from $2f_1$ to $4f_1$ as compared to the time required to sweep the octave from $f_1$ to $2f_1$. Moreover, the number of counter state changes required to sweep octaves yet higher in the musical scale would be even further decreased. As a consequence, the time interval required to sweep corresponding musical intervals in such an uncompensated system would proportionately decrease as higher octaves are swept. This condition is represented by the exponential curve 61 shown in FIG. 4. In addition, while the foregoing discussion has been in terms of octaves it will be appreciated that similar considerations apply to musical intervals of less than one octave. In any event, the result is, as previously explained, the musically undesirable effect of sweeping corresponding musical intervals in unequal time intervals.

The system of the present invention overcomes the foregoing problem through the illustrated use of rate multiplier 32. It will be recalled that twice the number of counter state changes are required for sweeping the octave from $f_1$ to $2f_1$ as compared to the octave $2f_1$ to $4f_1$. Rate multiplier 32 compensates for this difference by proportionately increasing the clocking rate of counter 22 during the former octave relative to the latter octave. That is, during the sweep of the octave from $f_1$ to $2f_1$ the average clocking rate of counter 22 is about twice that during the octave from $2f_1$ to $4f_1$. As a consequence, the output tone signals are swept along the straight line curve 62 shown in FIG. 4 in which corresponding musical intervals are swept in equal time intervals.

The foregoing method of compensation is directly attributable to the coupling of the program control code developed by counter 22 to the program input 30 of rate multiplier 32. In accordance with this technique, the output of rate multiplier 32 coupled through flip-flop 40 to the clock input of counter 22 has an effective frequency of 8192 $f_i$/65,536 during the production of the original tone signal at frequency $f_1$. As the program control code developed at the output of counter 22 incrementally decreases as the output tone signal is swept toward $2f_1$, the frequency of the output of rate multiplier 32 decreases proportionately. Finally, when the output tone signal reaches the frequency $2f_1$, the frequency of the output signal developed by rate multiplier 32 has been decreased by one-half to 4096 $f_1$/65,536. Similarly, in sweeping from $2f_1$ and $4f_1$ the output frequency of rate multiplier 32 is again reduced by a total of one-half. The overall effect produced by the foregoing is that the variance is counter state changes required to sweep corresponding musical intervals in different portions of the musical scale are compensated by clocking the counter proportionately more rapidly in lower portions of the musical scale to insure that the corresponding musical intervals are swept in equal time intervals. Thus, while the sweep of the octave from $f_1$ to $2f_1$ necessitates twice as many counter state changes as the sweep from $2f_1$ to $4f_1$, it is swept at a clock rate having an average value twice that of the latter octave. As a consequence, both octaves are swept in equal time intervals as required to produce proper portamento and glissando effects.

Again, while the preceding explanation has been in terms of sweeps of a whole octave, it will be appreciated that identical considerations apply to sweeping the output tone signals for musical intervals less than an octave. For example, the same compensation effects as discussed above will be observed when sweeping half octave intervals, semi-tone intervals and so on. And, although the discussion herein has been couched in terms of sweeping upwards in frequency, similar advantages are obtained when the frequency of the output tone signals are swept in a decreasing direction.

The purpose of flip-flop 40 is to synchronize the clock pulses applied to the clock input of counter 22 to the alternate phases of the high frequency clock $\phi_2$. This insures that counter 22 will not change state while programmable divider is clocking a $\phi_1$ pulse.

In FIG. 2, a second programmable divider 64 is shown connected to bus 26 for dividing a clock signal $\phi_3$, clock signal $\phi_3$ being characterized by a frequency somewhat greater than clock signal $\phi_1$. The output of divider 64 comprises a train of rectangular pulses having a frequency which varies proportionately with the frequency of the output tone signals and is useful for controlling various programmable circuits such as keyers, wave shapers or filters located in other portions of the instrument. Examples of such programmable circuits are disclosed in copending U.S. Patent Application Ser. No. 835,695 filed Sept. 22, 1977 in the name of Glenn Gross and entitled "Programmable Circuits for Electronic Musical Instruments" and in copending U.S. Application Ser. No. 920,277 filed July 13, 1978 in the name of Glenn Gross and entitled "Programmable Dynamic Filter".

It will be recognized that the clock signals used in the circuit shown in FIG. 2 may be derived by various alternate techniques. Thus, clock signal $\phi_1$, as well as $\phi_2$, may be derived from the source producing clock signal $\phi_3$ through the use of appropriate dividers. Also, the rate control clock signal $f_i$ may be derived from the same master clock via a programmable divider which could be programmed for providing different glissando and portamento rates.

Figures 5, 5A:
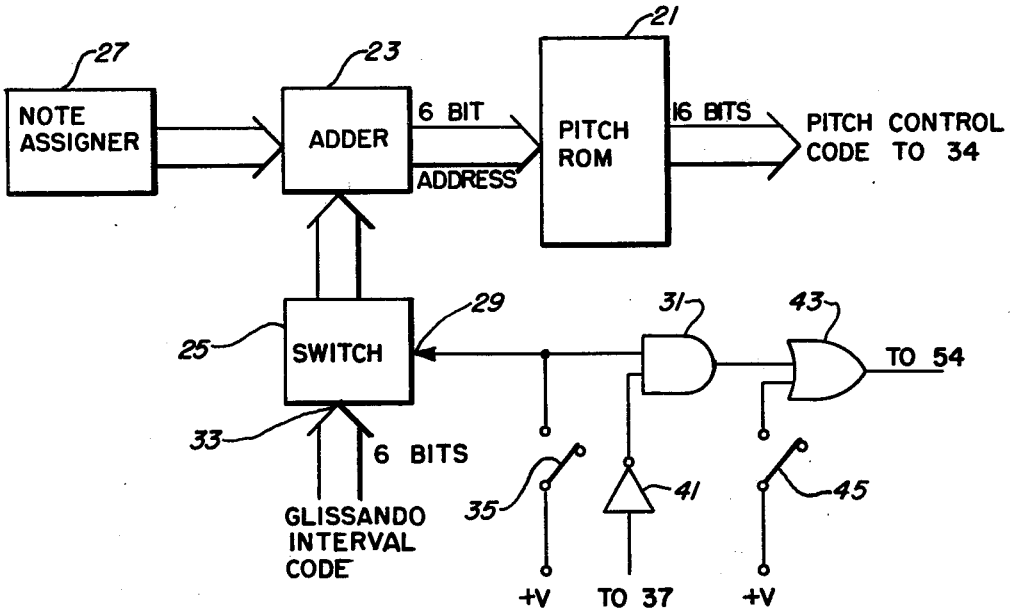
FIG. 5 is a functional block diagram illustrating one form of a control memory system useful in association with the circuit of FIG. 2.
FIG. 5A is a table illustrating the general technique of programming the control memory system of FIG. 5.

FIG. 5 illustrates one form of pitch control memory useful in association with the system of FIG. 2. Basically, the memory system, whose function is to supply portamento/glissando enable input 54 as well as the pitch control code to bus 34, comprises a suitably programmed ROM 21 addressed by a binary adder 23. The method of programming ROM 21 is shown in FIG. 5A wherein it will be observed that each of the, for example, 61 notes of a conventional musical instrument keyboard is associated with a particular 6 bit address and a corresponding 16 bit pitch control code. Thus, the selection of a particular ROM address by adder 23 results in the development of the corresponding pitch control code. Pitch control code 61153 (corresponding to pitch C1) would therefore be developed in response to an output address signal from adder 23 having a value of 1; pitch control code 57720 (corresponding to pitch C1#)

would be developed in response to an output address signal having a value of 2; and so on.

The output address signal developed by adder 23 are dependent on inputs from a switch 25 and from a note assigner 27. Note assigner 27 may be of conventional design and comprise a scanned keyboard system outputing a 6-bit address signal identifying an operated key of the musical instrument. Thus, note assigner 27 would couple a 6-bit address signal having a value of 3 to adder 23 in response to operation of the key corresponding to note D1. Assuming, for the moment, no other inputs to adder 23, this address signal (i.e. of value 3) is coupled to BOM 21 by the adder and addresses pitch control code 54481 which, of course, corresponds to an output tone signal having a frequency corresponding to the pitch of the selected note D1.

Switch 25, preferably comprising a 6-bit device, includes an enable input 29 connected to the first input of an AND gate 31 and a glissando interval code input 33. Input 33 is supplied with a fixed 6-bit code representative of the desired glissando interval. For example, referring to the table of FIG. 5A, a glissando interval code having a value of 2 would correspond to a glissando interval of two semitones.

Enable input 29 of switch 25 and the first input of AND gate 31 are further connected through a glissando enable switch 35 to a source of positive potential +V. The second input of AND gate 31 is supplied from the A=B output 37 of comparator 28 through an inverter 41. Finally, an OR gate 43, having an output for application to portamento/glissando enable input 54, includes a first input connected to the output of AND gate 31 and a second input coupled through a portamento enable switch 45 to a source of positive potential +V.

In considering the operation of the circuit of FIG. 5, initially assume that it is desired to sound an output tone signal representative of note C1. The key corresponding to note C1 is accordingly depressed whereupon note assigner 27 energizes note change detector input 60 and couples a 6-bit address signal having a value of 1 to adder 23. Since switch 25 is not enabled, the output of adder 23 also has a value of 1 and addresses pitch control code 61153 of ROM 21. The addressed pitch control code is coupled to bus 34 and, as previously explained, results in the development of an output tone signal corresponding to note C1. Now, assume that it is desired to produce a portamento effect from note C1 to note D1. This is accomplished by closing portamento enable switch 45 and depressing the key representing the newly selected note D1. Operation of switch 45 results in coupling a logically high level signal through OR gate 43 to portamento/glissando enable input 54 while note assigner 27 couples a 6-bit address having a value of 3 (corresponding to note D1) to adder 23 in response to operation of the newly selected key. It will be noted that switch 25 remains inhibited so that adder 23 also produces an output address signal having a value of 3. This output address signal addresses pitch control code 54481 which is coupled over bus 34 to produce the desired portamento effect as previously described. Lastly, consider the production of a glissando effect from the originally sounded output tone signal corresponding to note C1. For the purposes of discussion, it will be assumed that the 6-bit glissando interval code has a value of 2 corresponding to a glissando interval of two semitones. The glissando effect is now realized by simply closing glissando enable switch 35 and thereby enabling 6-bit switch 25 as well as coupling a logically high level signal to AND gate 31. Switch 25 thereby couples the glissando interval code (of value 2) to adder 23 where it is added to the address developed by note assigner 27 corresponding to the initially selected note C1 (i.e. address value 1). Summating the address from note assigner 27 and from switch 25 therefore results in an output address signal from adder 23 having a value of 3 so that pitch control code 54481 is addressed. It will be observed that the addressed pitch control code corresponds to the note D1 two semitones (the selected glissando interval) above the initial note C1. As before, this pitch control code is supplied to bus 34 to produce the desired effect. While, for purposes of clarity, the foregoing examples have been rather rudimentary in nature, it will be appreciated that the principles illustrated apply equally to the production of portamento and glissando effects by the circuit of the invention anywhere in the musical scale and between any selected notes or glissando intervals.

Figure 6:
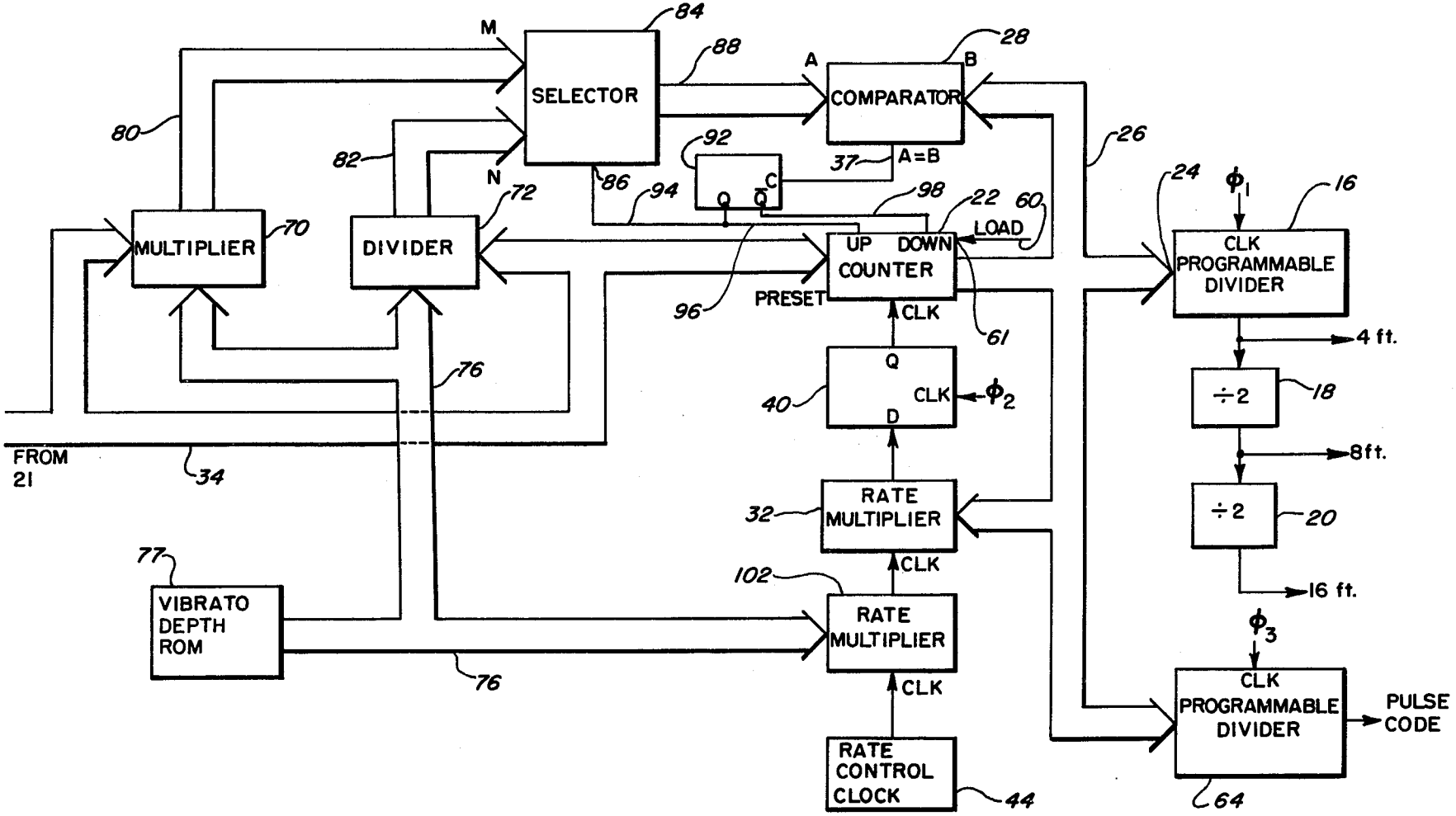
FIG. 6 is a block diagram illustrating the circuit of the present invention arranged for producting the musical effect of vibrato.

An adaptation according to the present invention of the circuit of FIG. 2 for producting the musical effect of vibrato is shown in FIG. 6. Two key features characterizing the vibrato circuit of FIG. 6 include its ability to maintain, within the range of normal operating conditions, a selected vibrato depth (i.e. percentage deviation from the center frequency) constant for output tone signals having different frequencies and its ability to provide complete vibrato cycles in equal time intervals for different vibrato depths about an output tone signal having a given frequency.

Referring now in detail to FIG. 6, it will be seen, as before, that the pitch control code is coupled by bus 34 to the preset inputs of counter 22. However, in addition, bus 34 couples the pitch control code to the first inputs of a binary multiplier 70 and a binary divider 72. The second inputs of multiplier 70 and divider 72 are supplied with a selected vibrato depth control code over a bus 76. The vibrato depth control code, which consists of a binary code having a value greater than 1.0, may be derived from a suitably programmed ROM 77 or the like. The outputs of multiplier 70 and divider 72 are applied to the M and N inputs of a selector circuit 84 by busses 80 and 82 respectively. Selector 84, in response to the logical level of a binary signal applied to its control input 86 couples the signal at its M input or N input to the A input of comparator 28 over a single 16 line bus 88.

The A=B control output 37 of comparator 28 is coupled to the clock input of a flip-flop 92, the flip-flop's Q output being connected to select input 86 of selector circuit 84 by a line 94 and also to counter 22 by a line 96 for enabling the counter to increase its state by counting in an upwardly direction. The $\bar{Q}$ output of flip-flop 92 is connected to counter 22 by a line 98 for enabling the counter to incrementally decrease its state by counting in a downwardly direction. As in the case of the FIG. 2 embodiment of the invention, counter 22 is clocked in response to the Q output of flip-flop 40 which is operated in response to clock signal $\phi_2$ and rate multiplier 32 as previously discussed. However, in addition, a second rate multiplier 102, having its program inputs connected for receiving the vibrato depth control code developed on bus 76, is coupled between rate multiplier 32 and rate control clock 44. Finally, the load input 61 of counter 22 is supplied directly from note change detector input 60 instead of through AND gate 58 as in the previous embodiment. The remainder of the circuitry shown in FIG. 5 is identical to that illustrated in FIG. 2 and will therefore not be discussed in detail.

In operation, a pitch control code corresponding to a selected output tone signal is coupled by bus 34 to the preset inputs of counter 22 and loaded into the counter in response to the development of a logically high level signal at note change detector input 60. The program control code developed at the output of counter 22 and applied by bus 26 to the B input of comparator 28 and to programmable dividers 26 and 64 as well as to rate multiplier 32 thus corresponds to the selected pitch control code. The selected pitch control code is also coupled to the first inputs of multiplier 70 and divider 72, the second inputs of the divider and multiplier being supplied with a selected vibrato depth control code from ROM 77 via bus 76. Assume, for purposes of an exemplary showing, that a selected output tone signal having a frequency $f_c$ corresponds to a pitch control code $F_c$ and that the vibrato depth control code corresponds to a value of 1.10. Multiplier 70 forms the product of the pitch control code and the vibrato depth control code to produce an output code on bus 80 corresponding to 1.1 $F_c$, hereinafter referred to as the sum code in that it can be expressed as $F_c$ plus an appropriate factor, while divider 72 divides the pitch control code by the vibrato depth control code producing a code on bus 82 corresponding to $F_c/1.1$, hereinafter referred to as the difference code in that it can be expressed as $F_c$ minus an appropriate factor.

Assuming that flip-flop 92 is initially in its Q=1 state, a logical one level signal is applied to select input 86 of selector 84 causing the sum code presented at the selector's M input to be coupled to the A input of comparator 28. At the same time, the Q output of flip-flop 92 enables counter 22 for increasing its state in response to clock pulses from flip-flop 40. Recalling that the initially selected program control code $F_c$, corresponding to an output tone signal of frequency $f_c$, is being presented to the B input of comparator 28, it will be seen that counter 22 incrementally advances its state from the initial program code toward the sum code. Upon achieving equalization between its A and B inputs, comparator 28 couples a logic signal over line 37 toggling flip-flop 92 and thereby causing it to assume its Q=0 state. In this state, selector 84 couples the difference code presented at its N input to the A input of comparator 28 and the logical 1 level signal at the $\overline{Q}$ output of flip-flop 92 enables counter 22 for incrementally decreasing its state. Counter 22 will thereby count down in response to clock pulses from flip-flop 40 decreasing its state from the sum code towards the difference code. In so doing, of course, the counter will pass through the state corresponding to the originally selected program control code. Upon detecting equality between its inputs, comparator 28 will again toggle flip-flop 92 causing the sum code to be applied to the A input of the comparator and enabling counter 22 for counting from the difference code back up towards the sum code.

As explained previously, programmable divider 16 follows the changes in the program control code developed at the output of counter 22 for developing a correspondingly changing output tone signal. The output tone signal will therefore exhibit a vibrato effect constituting a continuous cyclical frequency sweep between the two frequencies corresponding to the codes $1.1F_c$ and $F_c/1.1$.

From the foregoing, it will be appreciated that the codes coupled to the M and N inputs of selector 84 represent sum and difference codes equally displaced in terms of musical intervals about the selected pitch control code. That is, the sum and difference codes $1.1F_c$ and $F_c/1.1$ represent code values corresponding to tone signal frequencies which are symmetrically disposed by corresponding musical intervals about the vibrato center frequency $f_c$. Thus, if sum code $1.1F_c$ represents a frequency deviation below frequency $f_c$ of a given number of semitones, difference code $F_c/1.1$ would represent a frequency deviation above frequency $f_c$ of the same number of semitones. While for large values of vibrato depth control codes this results in a vibrato effect having an unsymmetrical frequency sweep, for smaller code values the unsymmetry is quite minimal. Since normal vibrato frequency deviations, usually about one-tenth semitone, are produced in response to relatively small vibrato depth control codes, the frequency sweep would therefore normally appear symmetrical in nature in terms of frequency to a listener.

As mentioned previously, it is desirable from a musical standpoint to maintain a constant vibrato depth for different frequency tone signals. Vibrato depth is typically expressed in terms of the ratio of the maximum frequency deviation to the center frequency. The effect on vibrato depth resulting from varying the vibrato center frequency is most clearly illustrated in connection with FIG. 4. With reference therefore to FIG. 4, it will be observed that a frequency deviation of $8f_1$ above the center frequency $8f_1$, i.e. frequency $16f_1$, results from a vibrato depth control code of 2.0. This deviation also corresponds to a vibrato depth 2.0. Now, if the center frequency is lowered one octave to $4f_1$, a vibrato depth control code of 2.0 produces a frequency deviation of $4f_1$ above the new center frequency to frequency $8f_1$. However, the vibrato depth nevertheless remains constant at 2.0. Significantly, it will be noted that even though the frequency deviation or sweep range has been reduced by one-half in the latter example, the vibrato depth did not change.

As in the case of the glissando and portamento circuit illustrated in FIG. 2, rate control clock 44 determines the vibrato speed or the rate at which the frequency modulation about the center frequency is accomplished. The output of rate control clock 44 is coupled through rate miltiplier 102 to compensate the vibrato speed for varying vibrato depth control codes. That is, from a musical viewpoint, it is desirable to achieve complete vibrato cycles in equal time intervals for different vibrato depths about a given tone signal frequency. Briefly, rate multiplier 102 proportionately increases the clocking rate of counter 22 in response to increasing vibrato depth codes to insure that the foregoing criterion is satisfied.

Figure 7:
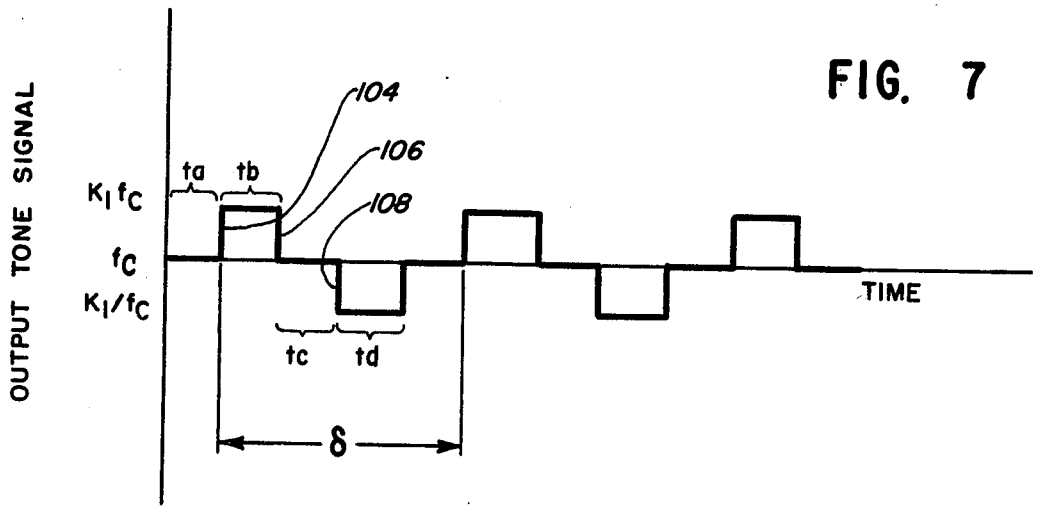
FIGS. 7–9 are graphs useful in illustrating the operation of the clircuit of FIG. 6.
Figure 8:
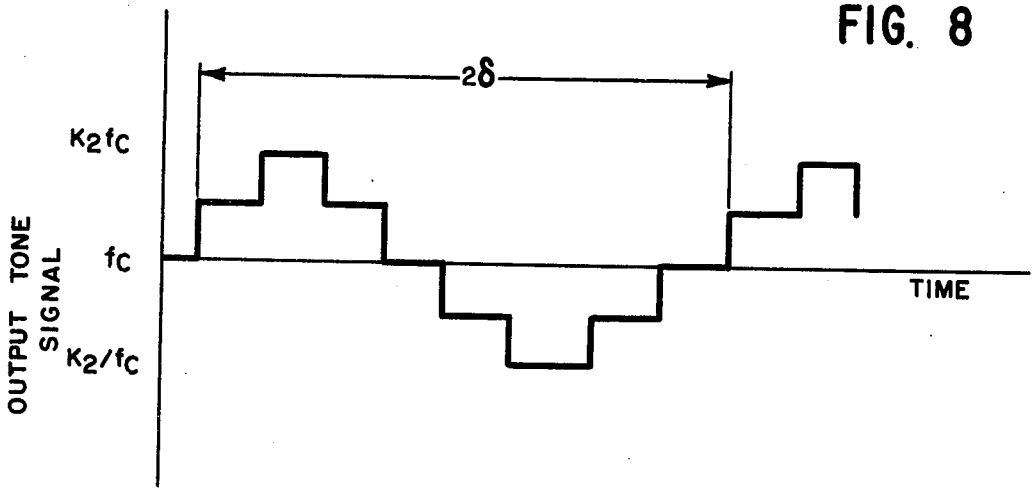
Figure 9:
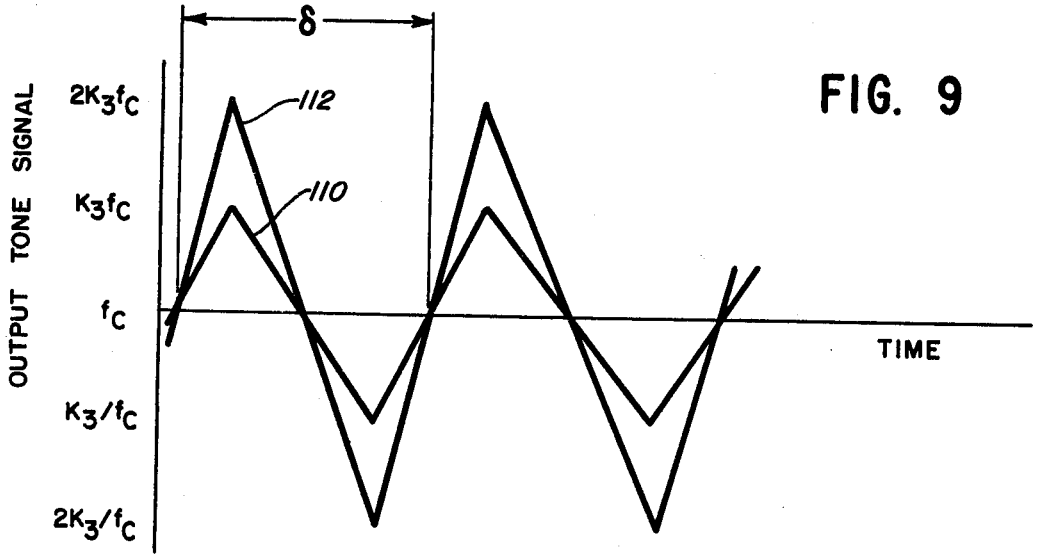

The specific manner in which rate multiplier 102 achieves the foregoing compensation effect may be more readily understood with reference to the graphs illustrated in FIGS. 7–9. FIGS. 7 and 8, although representing somewhat unrealistic conditions, clearly illustrate the effect requiring compensation while FIG. 9 more generally shows the vibrato depth control code compensation achieved by the circuit of the invention.

Referring, therefore, to FIG. 7, the frequency of an output tone signal versus time is shown for the case where the sum and difference codes each deviate from the center frequency $f_c$ by amounts equivalent to one state change of counter 22. Thus, the output tone signal is characterized by a vibrato effect wherein its frequency is cyclically swept between $K_1f_c$ and $K_1/f_c$. In terms of the program control code developed at the output of counter 22, it will be observed that the code during time interval $t_a$ corresponds to a value causing divider 16 to develop an output tone signal having a frequency $f_c$. At logical transition 104, the program control code is decreased one state so that during time interval $t_b$ the output tone signal is characterized by a frequency $K_1f_c$. Transition 106 corresponds to an increase of one state in the program control code whereby the output tone signal is again characterized by a frequency $f_c$ during time interval $t_c$. At transition 108, the program control code is increased one state such that during time interval $t_d$, the output tone signal is characterized by a frequency $f_c/K_1$. This process is continuously repeated whereby the program control code assumes some nominal value (corresponding to center frequency $f_c$), decreases one state (corresponding to a frequency $K_1f_c$), again assumes the nominal state, increases by one state (corresponding to frequency $K_1/f_c$), reassumes the nominal state and so on. It will in particular be noted that a complete vibrato cycle is completed in a time interval represented by $\delta$.

FIG. 8 illustrates the effect of doubling the vibrato depth control code for a tone output signal having the same center frequency as in the previous illustration. In this case, two program control state changes are required to sweep from the center frequency $f_c$ to one band edge $K_2f_c$. Similarly, two program control state changes are required to sweep back from $K_2f_c$ the center frequency $f_c$. Thereafter, an additional two program control state changes are required to sweep from $f_c$ to $K_2/f_c$ and two more state changes are required to sweep from $K_2/f_c$ back to the center frequency $f_c$. As a result, a complete vibrato cycle is achieved in a time interval corresponding to $2\delta$. Thus, doubling the vibrato depth code has the undesirable property of doubling the time interval to complete a full vibrato cycle.

Rate multiplier 102 compensates for the foregoing undesirable effect by proportionately increasing the clocking rate of counter 22 as the vibrato depth control code is increased. More specifically, the selected vibrato depth control code is directly applied to the program inputs of rate multiplier 102 via bus 76. Consequently, increased vibrato depth control codes cause rate multiplier 102 to clock rate multiplier 32 at proportionally increased speeds. Thus, with reference to the examples of FIGS. 7 and 8, rate multiplier 102 causes counter 22 to clock twice as fast for the vibrato depth control code represented by FIG. 8 relative to the vibrato depth control code represented in FIG. 7. The overall compensation effect is illustrated in FIG. 9. FIG. 9 shows a first output tone signal 110 exhibiting a vibrato effect having a selected vibrato depth corresponding to a frequency deviation about center frequency $f_c$ of $K_{3k}$. A second output tone signal 112 also exhibits a vibrato effect but with an increased vibrato depth corresponding to a frequency deviation of $2K_{3k}$. As explained above, rate multiplier 102 increases the clocking rate of counter 22 in the case of output tone signal 112 relative to output tone signal 110 such that a complete vibrato cycle is completed for each signal in the identical time interval $\delta$. Specifically, output tone signal 112 is produced by clocking counter 22 at twice the rate at which the counter is clocked when producing tone signal 110 to insure that both tone signals complete a full vibrato cycle in equal time intervals even though characterized by different vibrato depths. Stated otherwise, the larger vibrato depth control code supplied to rate multiplier 102 for the production of output tone signal 112 results in an increased clocking rate of counter 22 to compensate for the increased time interval which would otherwise be required to complete a full vibrato cycle.

As shown above, rate multiplier 102 compensates system operation to insure the production of complete vibrato cycles in equal time intervals for different vibrato depths about a given center frequency of an output tone signal. In addition, and as fully discussed herein, changing the position within the musical scale at which the vibrato effect is produced is fully compensated by rate multiplier 32. In this manner, the system of the invention produces complete vibrato cycles in equal time intervals for different vibrato depths about a given center frequency regardless of the position of the output tone signal in the musical scale.

It will be appreciated that the various circuits heretofore shown in FIGS. 2 and 6 may be combined into one single circuit along with appropriate electronic switching to determine which of the circuits will be operative at any given time. In this regard, FIG. 10 shows a technique for combining the circuits of FIGS. 2 and 6 for facilitating the automatic progression through a mode sequence such as vibrato-portamento-vibrato.

Figure 10:
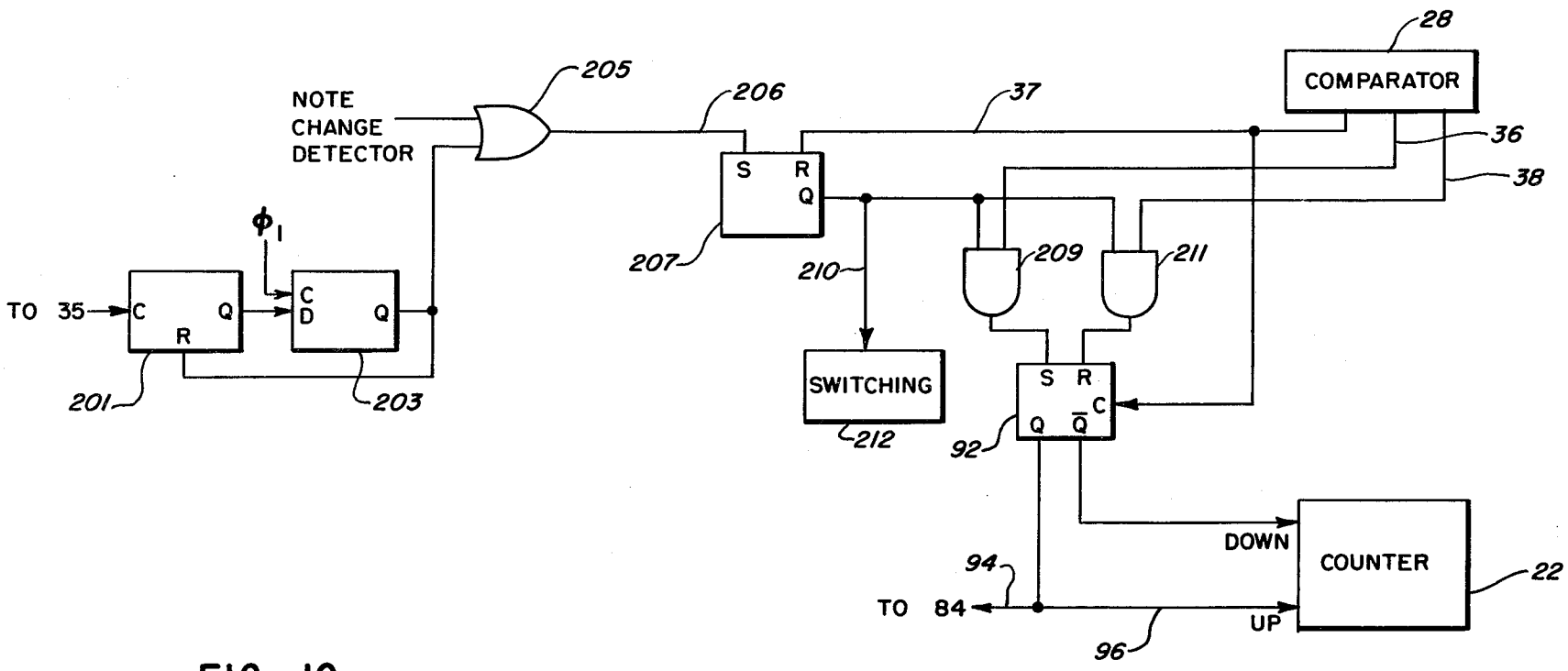
FIG. 10 is a block diagram illustrating a technique for combining the circuits of FIGS. 2 and 6.

In the circuit of FIG. 10, a one-shot circuit comprising flip-flops 201 and 203 is coupled between glissando enable switch 35 (see FIG. 5) and the first input of an OR gate 205. The second input to OR gate 205 is taken from the note change detector input 60 such as supplied by note assigner 27. It will be seen that a pulse is developed on the output 206 of OR gate 205 in response to a change in pitch resulting either from operation of glissando enable switch 35 or the depression of a new key. In either case, the pitch change output pulse is coupled to the set input of a steering flip-flop 207, the flip-flop's reset input being supplied from the A=B output 37 of comparator 28. The Q output of flip-flop 207 is connected to the first inputs of a pair of AND gates 209 and 211 and by a line 210 to various other electronic switches 212. Control lines 36 and 38 are coupled to the second inputs of AND gates 209 and 211, the outputs of the gates being connected to the set and reset inputs respectively of flip-flop 92. The Q and $\overline{Q}$ outputs of flip-flop 92 are connected to the up and down count enable inputs of counter 22 and to selector circuit 84 as illustrated in and discussed with respect to the vibrato circuit of FIG. 6.

To illustrate the operation of the circuit of FIG. 10, it is initially assumed that the instrument is operating in a vibrato mode about a frequency $f_1$. As will be explained in further detail, in the vibrato mode flip-flop 207 is in reset whereby its Q=0 output inhibits AND gates 209 and 211 and couples a 0 level signal to line 210. Accordingly, flip-flop 92 interfaces with comparator 28, counter 22 and selector circuit 84 identically as shown in the vibrato circuit of FIG. 6. In addition, the 0 level signal on line 210 suitably operates switches 212 for causing the remaining components of the vibrato circuit of FIG. 6 to be operative whereby a vibrato effect about frequency $f_1$ is produced as previously explained. Now, assume it is desired to increase the vibrato center frequency from $f_1$ to $4f_1$. This may be accomplished by depressing the key representing the note corresponding to frequency $4f_1$ or, in the alternative, by operating the glissando enable switch 35, assuming that a glissando interval of 2 octaves has been selected for the glissando interval code. In either case, a pulse is applied from the output of OR gate 205 setting flip-flop 207. The Q=1 output of flip-flop 207 is applied to line 210 and enables AND gates 209 and 211. Any logic signal developed on control line 36 of comparator 28 is thereby coupled through AND gate 209 to the set input of flip-flop 92 whose Q=1 output is coupled to lines 94 and 96. Similarly, any logic signal developed on control line 38 is coupled through AND gate 211 to the reset input of flip-flop 92 whose $\bar{Q}=1$ output is coupled to down count input of counter 22. This arrangement interfaces comparator 28 and counter 22 is a manner functionally equivalent to that shown in FIG. 2. Moreover, the 1 level signal coupled to switches 212 deactivates the vibrato producing circuitry while operating the portamento/glissando circuitry so that, in effect, the circuit of FIG. 2 is realized.

Returning to the previous illustration, it will be recalled that the system was initially operating in the vibrato mode about center frequency $f_1$. The circuit of FIG. 10 was subsequently activated setting flip-flop 207 for reconfiguring the system for operating in a portamento mode wherein the output tone signal frequency is swept from $f_1$ to $4f_1$. This frequency sweep, of course, results from the gradually decreasing program control code developed by counter 22 in response to the $\bar{Q}=1$ output of flip-flop 92, the flip-flop being held in reset by the signal coupled through AND gate 211 from control line 38. Upon completing the sweep, flip-flop 92 remains in its Q=0 state and a logic signal on A=B output 37 of comparator 28 resets flip-flop 207 to its Q=0 state for automatically switching system operation back to the vibrato mode, the only difference being that the center frequency is now $4f_1$ instead of the initial center frequency $f_1$. It will be recalled that at the completion of the frequency sweep from $f_1$ to $4f_1$, flip-flop 92 was in state Q=0. Consequently, upon resumption of the vibrato mode, the initial frequency deviation from center frequency $4f_1$ will be in an increasing direction corresponding to the coupling of the difference code on line 82 to comparator input A. In a similar manner, had the intermediate portamento sweep been one of decreasing frequency, such as from $4f_1$ to $f_1$, resulting from an increasing program control code, flip-flop 92 would be in its Q=1 state at the completion of the sweep. Thus, upon resumption of the vibrato mode, initiated by resetting flip-flop 207, the initial frequency deviation would be in a decreasing direction corresponding to the coupling of the sum code on line 80 to comparator input A. The key point is that, regardless of the direction of the intermediate portamento or glissando sweep, the initial deviation of the subsequent vibrato mode is in the same direction. This results in a more pleasing transition from the portamento or glissando mode to the vibrato mode than might otherwise be achieved.

Figure 11:
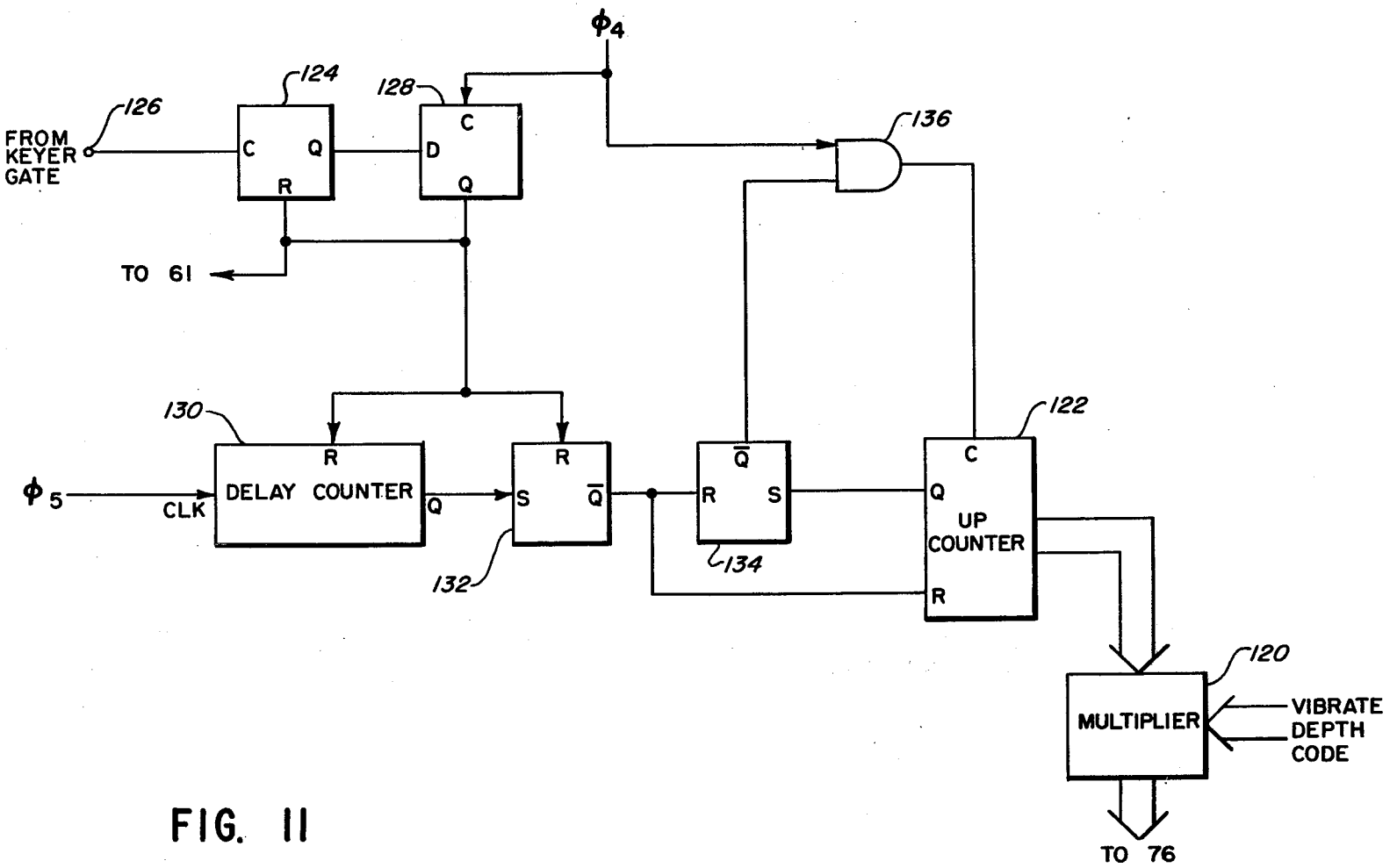
FIG. 11 is a functional block diagram showing a vibrato delay circuit useful in association with the circuit of FIG. 6.

It is often desirable to provide a delayed vibrato effect where the vibrato modulation does not commence immediately with the sounding of a note but rather is inhibited for a brief period of time and then builds up gradually to the selected level of modulation. FIG. 11 shows a circuit which, when combined with the circuit of FIG. 6, produces such a delayed vibrato effect. Briefly, in the circuit of FIG. 11, a binary multiplier 120 forms the product of the output of a counter 122 and a selected vibrato depth code for application to bus 76. Counter 122 is operative in response to the depression of a keyboard key for developing an output initially having a zero value, which output subsequently gradually increases to a maximum count. Since the vibrato depth code is of a constant value, the output of multiplier 120 supplied to bus 76 comprises, in response to the depression of a keyboard key, a zero value code for the predetermined time interval followed by a gradually increasing vibrato depth code building up to the selected level of modulation.

Referring in more detail to FIG. 11, a flip-flop 124 has its clock terminal connected to an input 126 comprising the output of a keyer gate of the musical instrument, the input 126 going logically high as long as a keyboard key is depressed. The Q output of flip-flop 124 is connected to the D input of a second flip-flop 128, the clock terminal of flip-flop 128 being supplied by clock signal $\phi_4$. The Q output of flip-flop 128, is connected to the reset input of flip-flop 124 and also comprises the load input 61 of counter 22. The Q output of flip-flop 128, in addition, supplies the reset terminals of a delay counter 130 and a first R-S flip-flop 132. The clock terminal of delay counter 130 is supplied by clock signal $\phi_5$ and its Q output is connected to the set input of flip-flop 132. In turn, the $\bar{Q}$ output of flip-flop 132 supplies the reset terminal of a second R-S flip-flop 134 and also the reset terminal of counter 122. The Q output of counter 122 is connected to the set input of flip-flop 134 whose $\bar{Q}$ output together with the $\phi_4$ clock signals are coupled through an AND gate 136 to the clock input of counter 122.

Upon depression of a keyboard key, the positive going edge of the signal developed at input 126 clocks flip-flop 124 causing its Q output and the D input of flip-flop 128 to go high. With its D input high, flip-flop 128 couples a $\phi_4$ clock pulse to its Q output resetting flip-flop 124 and causing a selected pitch control code to be preset in counter 22. The resetting of flip-flop 124 inhibits any further $\phi_4$ clock pulses from being coupled through flip-flop 128 so that only a single $\phi_4$ pulse is developed at the flip-flop's Q output.

The single $\phi_4$ pulse developed at the Q output of flip-flop 128 also resets delay counter 130 and flip-flop 132. As a result, delay counter 130 is initialized for counting $\phi_5$ clock pulses while the $\bar{Q}$ output of flip-flop 134 holds counter 122 in reset and causes the $\bar{Q}$ output of flip-flop 134 to go high while delay counter 130 counts $\phi_5$ clock pulses. Therefore, the output of counter 122 supplied to multiplier 120 is maintained at a zero value, even though AND gate 136 is enabled by the $\bar{Q}$ output of flip-flop 134.

After a predetermined time interval, delay counter 130 achieves an overflow state whereby its Q output goes high setting flip-flop 132 which takes counter 122 and flip-flop 134 out of reset. Since the $\bar{Q}$ output of flip-flop 134 remains logically high, $\phi_4$ clock pulses are coupled through AND gate 36 to the clock input of counter 122 causing the counter output to incrementally advance at a corresponding rate. When counter 122 reaches its maximum state, an overflow condition occurs whereby its Q output goes logically high setting flip-flop 134 which, in turn, inhibits AND gate 136 from coupling any further $\phi_4$ clock pulses thereby latching counter 122 in its maximum state. It will therefore be seen that the output of counter 122 is initially held in a zero state for a predetermined time interval, as determined by the operation of delay counter 130, and then gradually increases until its maximum state is achieved. Consequently, the output of multiplier 120 provides a delayed vibrato depth code to bus 76 causing, after the predetermined time interval following the depression of a key, the frequency deviation of the selected output tone signal to increase gradually from its center frequency until the selected depth is achieved.

While particular embodiments of the present invention have been shown and described, it will be apparent that changes and modifications may be made therein without departing from the invention in its broader aspects. The aim of the appended claims, therefore, is to cover all such changes and modifications as fall within the true spirit and scope of the invention.

What is claimed is:

1. A tone generator for use with a musical instrument comprising:

clock means operable for developing a clock signal;

counting means characterized by a plurality of states, said counting means being enableable for incrementally changing state in response to said clock signal;

means for operating said clock means for developing a clock signal having a repetition rate related to the state characterizing said counting means; control means operable for selectively enabling said counting means for incrementally changing state; and means responsive to said counting means for developing an output tone signal having a frequency corresponding to the state characterizing said counting means.

2. The tone generator according to claim 1 wherein said clock means comprises means operated for developing a clock signal having a repetition rate directly proportional to the state of said counting means.

3. The tone generator according to claim 1 wherein said control means includes a comparator for enabling said counting means for incrementally changing state from a first selected state to a second selected state.

4. The tone generator according to claim 1 wherein said control means includes comparison means for enabling said counting means for incrementally changing state in a cyclical manner about a selected center state and between a pair of selected deviation states symmetrically related to said center state in terms of musical intervals.

5. The tone generator according to claim 4 wherein said clock means includes compensating means for causing a complete cycle of state changes of said counting means about said center state to be accomplished in a predetermined time interval independently of the value of said deviation states.

6. The tone generator according to claim 5 including means for maintaining the ratio between the value of one of said deviation states to said center state constant independently of the value of said center state.

7. The tone generator according to claim 3 including means for selectively developing first and second binary codes corresponding to said first and second states and means coupling said first code for presetting said counting means to said first state.

8. The tone generator according to claim 7 wherein said counting means comprises a binary counter having a plurality of outputs characterized by logic signals corresponding to the state thereof and a clock input, said comparator having a first input connected for receiving said second binary code and a second input connected to said plurality of counter outputs, said comparator enabling said counter for incrementally advancing or decreasing its state from said first state to said second state in response to the value of said second binary code being, respectively, greater or less than the value of the state of said counter.

9. The tone generator according to claim 7 wherein said clock means and said means for operating said clock means comprise:

a clock for developing a train of clock pulses at a predetermined repetition rate;

means responsive to said train of clock pulses and to said plurality of counter outputs for developing an output clock signal having a repetition rate directly proportional to the state of said counter; and means applying said output clock signal to said clock input of said counter.

10. The tone generator according to claim 9 wherein said means for developing an output clock signal comprises means for multiplying said predetermined repetition rate of said train of clock pulses by a factor having a value directly proportional to the value of the state of said counter.

11. The tone generator according to claim 9 wherein said means for developing an output clock signal comprises a rate multiplier having a plurality of program inputs connected to said plurality of counter outputs, a clock input connected for receiving said train of clock pulses and an output for developing said output clock signal.

12. The tone generator according to claim 8 wherein said means for developing an output tone signal comprises a source of high frequency clock pulses and a programmable divider for dividing said high frequency clock pulses to obtain said output tone signal, said programmable divider having a plurality of program inputs connected to said plurality of counter outputs for setting the division ratio thereof in accordance with the state of said counter.

13. The tone generator according to claim 8 wherein said counter includes a count-up enable input and a count-down enable input, said comparator developing a signal on said count-up input enabling said counter for incrementally advancing its state in response to the value of the binary word at its first input exceeding the value of the binary word at its second input and developing a signal on said count-down input enabling said counter for incrementally decreasing its state in response to the value of the binary word at its second input exceeding the value of the binary word at its first input.

14. The tone generator according to claim 6 including means for selectively developing a third binary code and a vibrato code defining said counting means center state and said deviation states, respectively, and further including means coupling said third code for presetting said counting means to said center state.

15. The tone generator according to claim 14 wherein said clock means comprises means operated for developing a clock signal having a repetition rate directly proportional to the state of said counting means and to the value of said vibrato code.

16. The tone generator according to claim 14 wherein said control means comprises:

means multiplying said third binary code with said vibrato code for developing an output signal comprising a first deviation code defining one of said deviation states; and means dividing said third binary code by said vibrato code for developing an output signal comprising second deviation code, said difference code defining the other of said deviation states.

17. The tone generator according to claim 16 wherein said counting means comprises a binary counter having a plurality of outputs characterized by logic signals corresponding to the state thereof and a clock input, said control means comprising selection means having first and second inputs connected for receiving said first and second deviation codes respectively, a control input and an output, said selection means coupling said first deviation code to the output thereof in response to said control input being at a first logic level and coupling said second deviation code to the output thereof in response to said control input being at a second logic level.

18. The tone generator according to claim 17 wherein said control means further comprises a binary comparator having a first input connected to the output of said selection means and a second input connected to said plurality of counter outputs, said comparator enabling said counter for incrementally advancing or decreasing its state in response to, respectively, said first or second deviation code being coupled to the output of said selection means, said comparator further including an output coupled to said selection means control input for developing a logic signal changing state in response to coincidence between the value of the binary words at said first and second inputs of said comparator means.

19. The tone generator according to claim 15 wherein said clock means and said means for operating said clock means comprise:

a clock for developing a train of clock pulses at a predetermined repetition rate;

means responsive to said train of clock pulses, to said plurality of counter outputs and to the value of said vibrato code for developing an output clock signal having a repetition rate directly proportional to the state of said counter and to the value of said vibrato code; and means applying said output clock signal to said clock input of said counter.

20. A tone generator according to claim 19 wherein said means for developing an output clock signal comprises means for multiplying said predetermined repetition rate of said train of clock pulses by a first factor having a value directly proportional to the value of the state of said counter and by a second factor having a value directly proportional to the value of said vibrato code.

21. The tone generator according to claim 20 wherein said means for developing an output clock signal comprises a first rate multiplier having a plurality of program inputs connected for receiving said vibrato code, a clock input connected for receiving said train of clock pulses and an output for developing an intermediate clock signal, and a second rate multiplier having a plurality of program inputs connected to said plurality of counter outputs, a clock input connected for receiving said intermediate clock signal and an output for developing said output clock signal.

22. The tone generator according to claim 17 wherein said means for developing an output tone signal comprises a source of high frequency clock pulses and a programmable divider for dividing said high frequency clock pulses to obtain said output tone signal, said programmable divider having a plurality of program inputs connected to said plurality of counter outputs for setting the division ratio thereof in accordance with the state of said counter.

23. The tone generator according to claim 16 including means developing a delay code comprising a zero value code for a predetermined interval and a code having a value gradually increasing therefrom to a maximum value and means forming the product of said delay code and said vibrato code for defining a delayed vibrato code comprising said vibrato code.

24. The tone generator according to claim 23 wherein said musical instrument includes a plurality of keys each representative of a respective musical note and wherein said means developing a delay code comprises a delay counter and logic means operating said delay counter, said logic means being responsive to the depression of one of said keys for inhibiting said delay counter for said predetermined interval and thereafter operating said delay counter for incrementally advancing its state to said maximum value.

25. The tone generator according to claim 1 wherein said control means is operated for enabling said counting means for incrementally changing state in a cyclical manner about a first selected center state followed by incrementally changing state from said first selected center state to a second selected center state followed by incrementally changing state in a cyclical manner about said second selected center state.

26. The tone generator according to claim 25 including means for operating said counting means such that the initial state change of said counting means about said second selected center state is dependent upon the values of said first and second selected center states.

27. The tone generator according to claim 26 wherein said initial state change is in an up-count direction when said second selected center state exceeds said first selected center state and in a down-count direction when said first selected center state exceeds said second selected center state.

28. In an electronic musical instrument having means for selectively developing a plurality of digital codes each representative of a respective musical note, the improvement comprising:

up/down counting means having a clock input, an up/down count enable input and an output;

means for presetting the content of said counting means according to a first selected one of said digital codes;

comparison means having a first input connected for receiving a second selected one of said digital codes and a second input connected to said counting means output, said comparison means having an output connected to said counting means up/down count enable input for enabling said counting means for counting up or down in response to said second code exceeding or being less than said first code respectively;

means connected to said counting means clock input for clocking said counting means at a rate dependent upon the content thereof; and divider means for developing an output tone signal having a frequency corresponding to the content of said counting means.

29. The improvement according to claim 28 wherein said means for clocking comprises:

a clock for developing a train of clock pulses at a predetermined repetition rate;

means responsive to said train of clock pulses and to the content of said counting means for developing an output clock signal having a repetition rate directly proportional to the state of said counting means; and means applying said output clock signal for clocking said counting means.

30. The improvement according to claim 29 wherein said means for developing an output clock signal comprises a rate multiplier having a plurality of program inputs responsive to the content of said counting means, a clock input connected for receiving said train of clock pulses and an output for developing said output clock signal.

31. In an electronic musical instrument having means for selectively developing a digital code representative of a respective musical note, and a vibrato code representative of a vibrato depth about a selected note; the improvement comprising:

counting means having a clock input and an output;

means for setting the content of said counting means according to a selected one of said digital codes;

means responsive to said selected digital code and to a desired one of said vibrato codes for developing a first deviation code comprising said selected digital code multiplied by said desired vibrato code and a second deviation code comprising said selected digital code divided by said desired vibrato code;

comparison means having a first input for receiving said first and second deviation codes and a second input connected to said counting means output, said comparison means enabling said counting means for counting in a cyclical manner between said first and second deviation codes;

divider means for developing an output tone signal having a frequency corresponding to the content of said counting means.

32. The improvement according to claim 31 wherein said means for clocking comprises means clocking said counting means at a rate dependent upon the content thereof and upon the value of said desired vibrato code.

33. The improvement according to claim 32 wherein said means for clocking comprises:

a clock for developing a train of clock pulses at a predetermined repetition rate;

a first rate multiplier having a plurality of program inputs responsive to said desired vibrato code, a clock input connected for receiving said train of clock pulses and an output for developing an intermediate clock signal;

a second rate multiplier having a plurality of program inputs responsive to the content of said counting means, a clock input connected for receiving said intermediate clock signal and an output for developing said output clock signal.

34. The improvement according to claim 31 wherein said comparison means comprises:

a comparator having a first input, a second input connected to the output of said counting means and an output developing a control signal in response to coincidence between the value of the digital words at said first and second inputs; and selection means operable in a first mode for coupling said first deviation code to said comparator first input and enabling said counting means for incrementally advancing its state and in a second mode for coupling said second deviation code to said comparator first input and enabling said counting means for incrementally decreasing its state, said selection means changing its mode of operation in response to the development of said comparator control signal.

* * * * *